US006304031B1

(12) United States Patent
Wani et al.

(10) Patent No.: US 6,304,031 B1
(45) Date of Patent: Oct. 16, 2001

(54) PLASMA DISPLAY PANEL

(75) Inventors: Koichi Wani, Takatsuki; Kazunori Hirao, Yao, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/118,840

(22) Filed: Jul. 20, 1998

(30) Foreign Application Priority Data

Aug. 1, 1997 (JP) ..... 9-207515

(51) Int. Cl.[7] ..... H01J 17/49

(52) U.S. Cl. ..... 313/582; 313/584; 313/585; 313/587; 345/60

(58) Field of Search ..... 313/582, 583, 313/584, 585, 586, 587; 345/60, 67, 68, 37

(56) References Cited

U.S. PATENT DOCUMENTS 5,841,232 * 11/1998 Hirao et al. ..... 313/585

FOREIGN PATENT DOCUMENTS 0488891 6/1992 (EP) .
802556 10/1997 (EP) .
2-284332 11/1990 (JP) .
03187125 8/1991 (JP) .
08315735 11/1991 (JP) .
4-195188 7/1992 (JP) .
8-179726 7/1996 (JP) .

* cited by examiner

*Primary Examiner*—Ashok Patel
(74) *Attorney, Agent, or Firm*—Greenblum & Berstein, P.L.C.

(57) ABSTRACT

A high-capacity, high-definition plasma display panel capable of providing a high-quality image has an image display area 16 within which pairs of sustaining electrodes and pairs of scanning electrodes are disposed in an alternating fashion with each other. Each pair of the sustaining electrodes are connected at their opposite ends with each other and, similarly, each pair of the scanning electrodes are connected at their opposite ends with each other. A unitary pixel is defined at an intersection between one of data electrodes 8 and a group including a pair of the scanning electrode, one of pair of the sustaining electrodes adjacent such pair of the scanning electrodes and one of the next succeeding pair of the sustaining electrodes adjacent such pair of the scanning electrodes.

14 Claims, 7 Drawing Sheets

PLASMA DISPLAY PANEL

FIELD OF THE INVENTION

The present invention relates to a plasma display panel for visual presentation of images such as used in a television receiver set and, more particularly, to an electrode structure in a high-capacity, high-definition plasma display panel.

BACKGROUND OF THE INVENTION

The plasma display panel (PDP as used hereinafter) has recently come to be the center of interest as it would provide a basis for development of a wall-mount television receiver set. The plasma display panel currently available in the market is of a structure shown in FIG. 8 and will now be discussed.

The prior art plasma display panel is shown in FIG. 8 in a partially cut-out perspective representation. In this prior art PDP, first and second substrates 1, 2 are disposed in face-to-face relationship with a plurality of elongated partition walls 3 intervening therebetween, and a rare gas is filled between the first and second substrates 1, 2. A plurality of elongated scanning electrodes 4 are arranged parallel to each other on a surface of the first substrate 1. Also, a plurality of elongated sustaining electrodes 5 are arranged parallel to each other in an alternating fashion with the scanning electrodes 4 on the surface of the first substrate 1. A dielectric layer 6 is formed on the surface of the first substrate 1 so as to cover the scanning and sustaining electrodes 4, 5, which is in turn covered by a protective layer 7. A plurality of data electrodes 8 are provided on a surface confronting the first substrate 1, which are elongated in a direction perpendicular to the scanning and sustaining electrodes 4, 5. A discharge cell 9 is formed at intersection of the scanning and sustaining electrodes 4, 5 and the data electrode 8. The data electrodes 8 are set apart form each other by the partition walls 3, respectively. A fluorescent material 10 is deposited between the partition walls 3 so as to cover the data electrode 8. A unitary pixel is defined by one scanning electrode 4, one sustaining electrode 5 and one data electrode 8. A unitary pixel is defined by one scanning electrode 4, one sustaining electrode 5 and one data electrode 8.

A gradation display method of this prior art PDP such as described in the Japanese Laid-open Patent Publication No. 4-195188, published in 1992, is shown in FIG. 9. In this prior art PDP, a single field representative of one picture is divided into eight sub-fields $b_0$ to $b_7$ and each sub-field is also divided into an address interval and a sustaining interval. During the address interval, scanning electrodes 4 are sequentially selected to allow data to be written in all pixels. During the sustaining interval following the address interval, an alternating voltage is applied between the scanning electrodes 4 and sustaining electrodes 5 to cause all of the pixels, in which the data was written, to energized to emit light for a predetermined duration. By choosing the proportion of the length of the sustaining interval of each sub-field to be 1, 2, 4, 8, 16, 32, 64 and 128, a display in 256 gradation levels, that is, a 256 gradation image can be obtained.

With the prior art PDP, increase of the number of the electrodes in an attempt to increase the definition of displayed images tends to result in reduction of the address interval allocated to each scanning electrode and, therefore, this involves a problem associated with the discharge not occurring assuredly. By way of example, if the 256-level gray scale image is to be displayed by a high-definition PDP having 1,000 or more scanning electrodes, the length of time allocated for data write-in would be $(1/60) \div 1{,}000 \div 8 \approx 2\ \mu s$ or smaller for each scanning electrode. While the length of time required for a discharge to be formed in each discharge cell of the PDP is generally equal to or lower than 1 $\mu$s, the length of time required to complete the discharge formation often fluctuates and, therefore, the discharge formation often takes about a few microseconds. In view of this, when the width of the write-in pulse is equal to or smaller than 2 $\mu$s, there is a considerably high risk of occurrence of a write-in error in which a write-in discharge will not set up sufficiently, which eventually brings about drop-out and/or flickering taking place in the displayed image.

Also, in the high-definition PDP, in order to increase the aperture and/or to avoid any possible contact or interference between the neighboring electrodes, efforts have centered on reducing the width of each electrode to a value as small as possible. In such case, there is a considerably high risk of occurrence of rejected products as a result of breakage of the electrode during the manufacture of the PDPs.

Even though no breakage of the electrodes occur during the manufacture of the PDPs, the electrodes if partially small in width are susceptible to breakage during the use thereof as a result of heat generated upon supply of an electric power therethrough. Once this occurs, the electrodes will no longer be useable. Inspection as to the presence or absence of the partially small width in the electrodes has been extremely difficult to achieve.

SUMMARY OF THE INVENTION

Accordingly, the present invention is intended to provide an improved plasma display panel which is substantially free from the above discussed problems inherent in the prior art plasma display panel.

To this end, the present invention provides a plasma display panel of a kind which comprises first and second substrates disposed in face-to-face relationship with a discharge space intervening therebetween, a plurality of data electrodes formed on the first substrate, and a plurality of sets of at least first and second scanning electrodes formed on the second substrate so as to extend perpendicular to the data electrodes, and a plurality of sets of at least first and second sustaining electrodes formed on the second substrate so as to extend perpendicular to the data electrodes in an alternating fashion with the sets of the scanning electrodes. A unitary pixel is defined at an intersection between each data electrode and a group of each set of the scanning electrodes, the first sustaining electrode of one set which is positioned on one side of and adjacent such set of the scanning electrodes and the second sustaining electrode of the next succeeding set which is positioned on the other side of and adjacent such set of the scanning electrodes. Each set of the scanning electrodes included within the respective unitary pixel are adapted to receive a scanning pulse substantially simultaneously.

To make it possible that each set of the scanning electrodes forming a part of the respective unitary pixel to receive the scanning pulse substantially simultaneously, and also to allow one of the scanning electrodes of each set to survive even though a line breakage occurs in the other scanning electrode, each set of the scanning electrodes are preferably connected at their opposite ends with each other.

According to the present invention, even though the width of address pulses is reduced, a high-quality image reproduction is possible with the minimized write-in error.

BRIEF DESCRIPTION OF THE DRAWINGS

The present invention will become readily understood from the following description of a preferred embodiment thereof made with reference to the accompanying drawings, in which like parts are designated by like reference numeral and in which.

DETAILED DESCRIPTION OF THE EMBODIMENT

Figure 1:
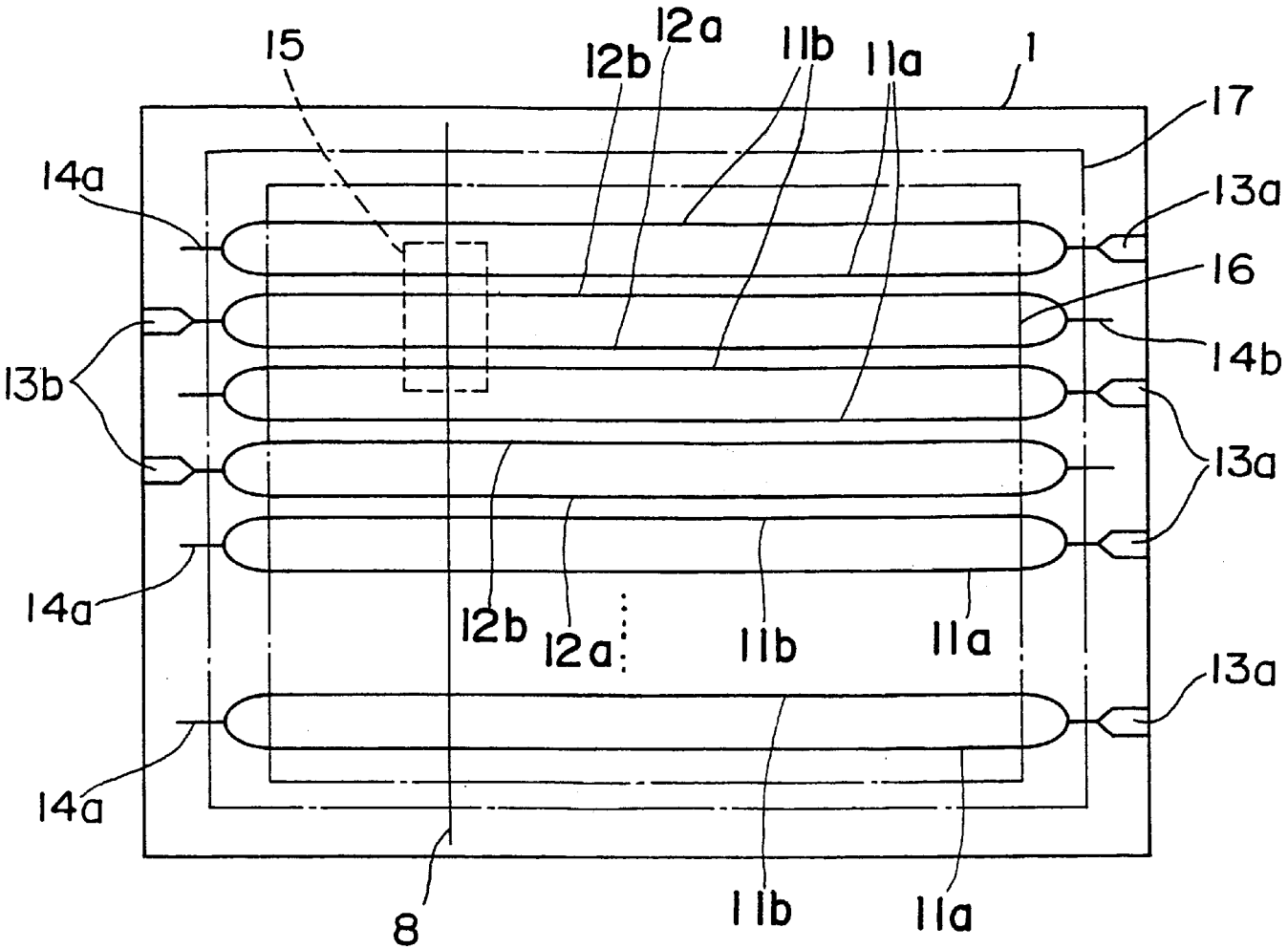
FIG. 1 is a schematic plan view showing an electrode structure embodied in a plasma display panel according to a preferred embodiment of the present invention.
Figure 5:
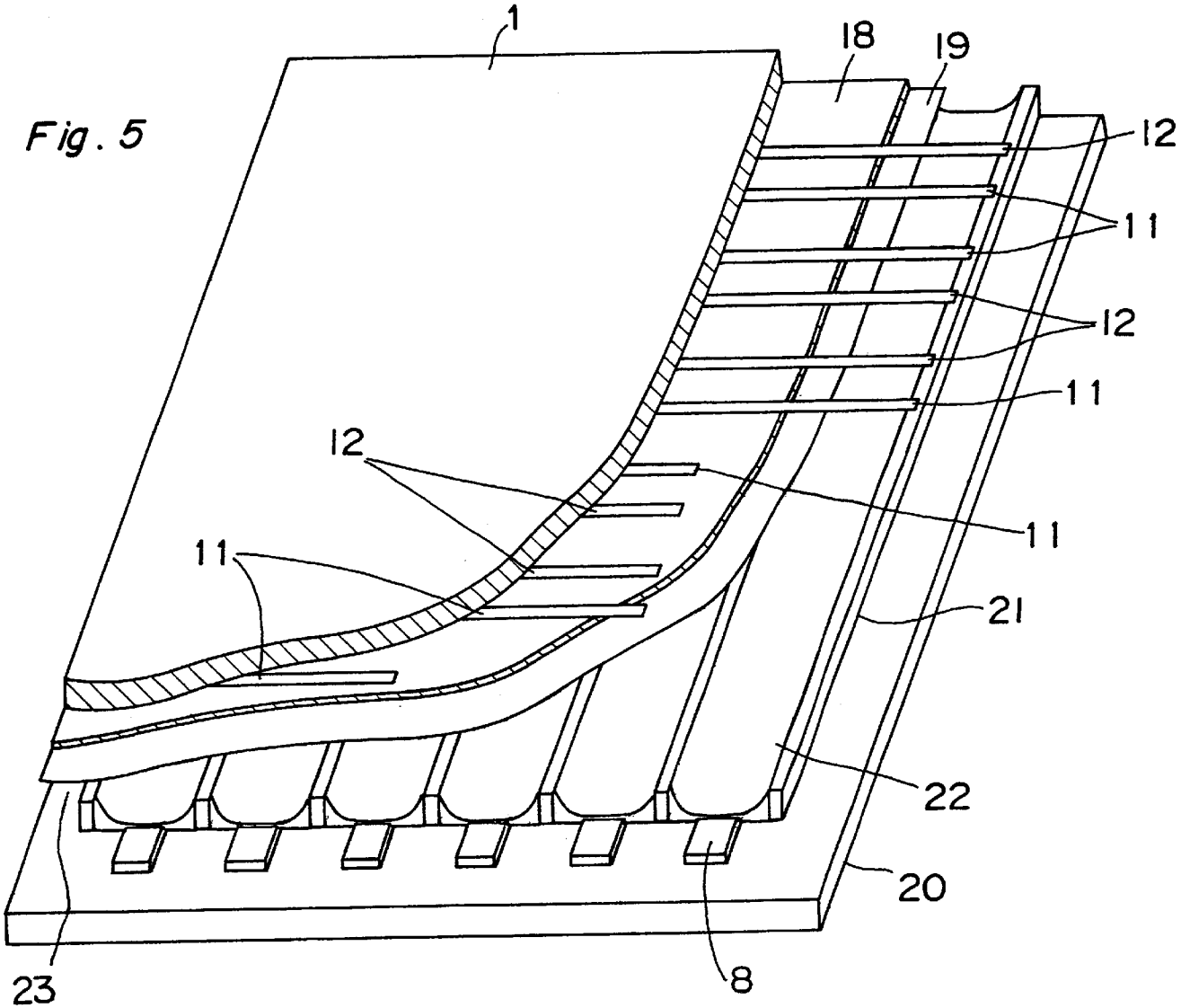
FIG. 5 is a partially cut-out perspective view of the PDP of the present invention.

Referring particularly to FIGS. 1 and 5, a plasma display panel embodying the present invention comprises a first substrate 1. Sets of at least first and second sustaining electrodes 11*a* and 11*b* connected at their opposite ends with each other to form a respective sustaining electrode loop are formed on the surface of the first substrate 1 so as to extend parallel to each other within a image display area 16. Similarly, sets of at least first and second scanning electrodes 12*a* and 12*b* connected at their opposite ends with each other to form a respective scanning electrode loop are formed on the surface of the first substrate 1 so as to extend parallel to each other and also to the sustaining electrodes 11*a* and 11*b* within the image display area 16. The sets of the sustaining electrodes 11*a* and 11*b* and the sets of the scanning electrodes 12*a* and 12*b* so formed on the same surface of the first substrate 1 alternate with each other in a direction substantially perpendicular to the longitudinal sense of the rectangular image display area 16.

A dielectric layer 18 is deposited on the surface of the first substrate 1 so as to cover the respective sets of the sustaining and scanning electrodes 11*a*, 11*b* and 12*a*, 12*b*, which is in turn covered by a protective layer 19. A connection between respective one ends of the first and second sustaining electrodes 11*a* and 11*b* of each set is connected with a circuit connecting terminal 13*a* positioned on the first substrate 1 outside a sealing zone 17 which is defined outside the image display area 16, whereas a connection between the respective opposite ends of the first and second sustaining electrodes 11*a* and 11*b* may be utilized as a repair terminal as indicated by 14*a*. On the other hand, a connection between respective one ends of the first and second scanning electrodes 12*a* and 12*b* of each set, which are remote from the circuit connecting terminal 13*a*, is connected with a similar circuit connecting terminal 13*b* also positioned on the first substrate 1 outside the sealing zone 17, whereas a connection between the respective opposite ends of the first and second scanning electrodes 12*a* and 12*b* of each set may be utilized as a repair terminal as indicated by 14*b*.

The circuit connecting terminals 13*a* of the sets of the first and second sustaining electrodes 11*a* and 11*b* are electrically connected with a sustaining pulse generator (not shown) whereas the circuit connecting terminals 13*b* are electrically connected with a scanning pulse generator (not shown). The repair terminals 14*a* and 14*b* are connected with nothing.

The PDP also comprises a plurality of data electrodes 8 formed on one of opposite surfaces of a second substrate 20, which confronts the first substrate 1, so as to extend in a direction perpendicular to the direction of extension of any one of the sets of the sustaining and scanning electrodes while regularly or equidistantly spaced a distance from each other. As best shown in FIG. 5, an elongated partition wall 21 is disposed between each neighboring data electrodes 8, and a fluorescent material 22 is deposited within a space between each neighboring partition walls 21 to adhere not only to the respective data electrode 8, but also to mutually confronting side faces of the neighboring partition walls 21.

The first and second substrates 1 and 20 are disposed in face-to-face relationship with the partition walls 21 intervening therebetween so that a discharge space 23 can be defined between the first and second substrates 1 and 20, in which space 23 is filled a rare gas such as neon or xenon.

The PDP of the structure described above further comprises a plurality of unitary pixels 15 each defined at an intersection between each data electrode 18 and a group of the first and second scanning electrodes 12*a* and 12*b* of each set, the first sustaining electrode 11*a* of one set adjacent the second scanning electrode 12*b*, and the second sustaining electrode 11*b* of the next succeeding set adjacent the first scanning electrode 12*a*.

Figure 6:
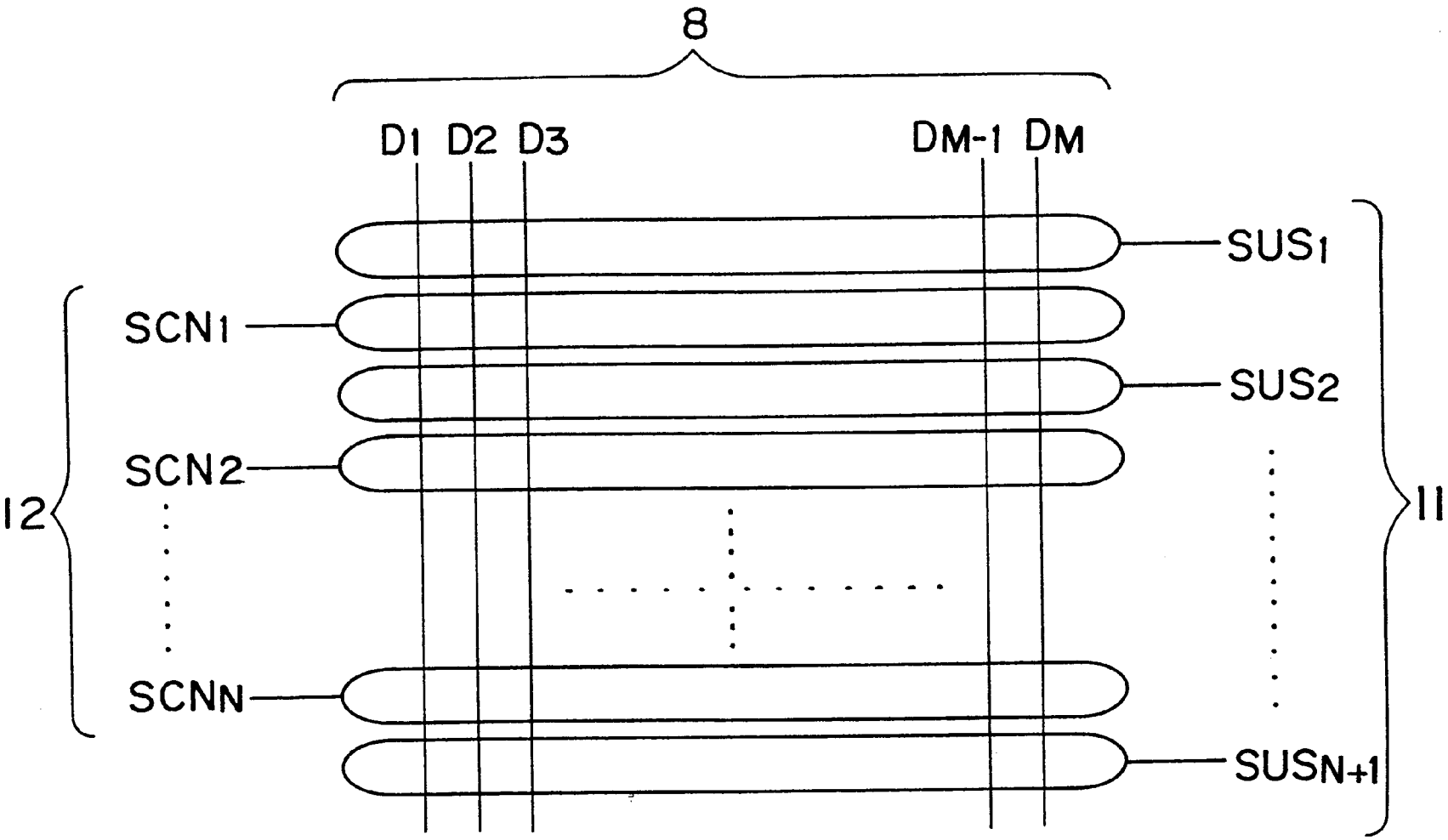
FIG. 6 is a schematic plan view showing the electrode structure in the PDP of the present invention.

The operation of the PDP embodying the present invention will now be described with particular reference to FIGS. 6 and 7. Assuming that each set of the first and second sustaining electrodes 11*a* and 11*b* is represented by a sustaining line $SUS_1$ to $SUS_{N+1}$ (N representing the number) and each set of the first and second scanning electrodes 12*a* and 12*b* is represented by a scanning line $SCN_1$ to $SCN_N$, it will readily understood from FIG. 6 that the sustaining lines $SUS_1$ to $SUS_{N+1}$ and the scanning lines $SCN_1$ to $SCN_N$ alternate with each other and extend perpendicular to the data electrodes $D_1$ to $D_M$. Drive voltages supplied to this PDP are illustrated in FIG. 7 in a timed relation to each other.

Figure 7:
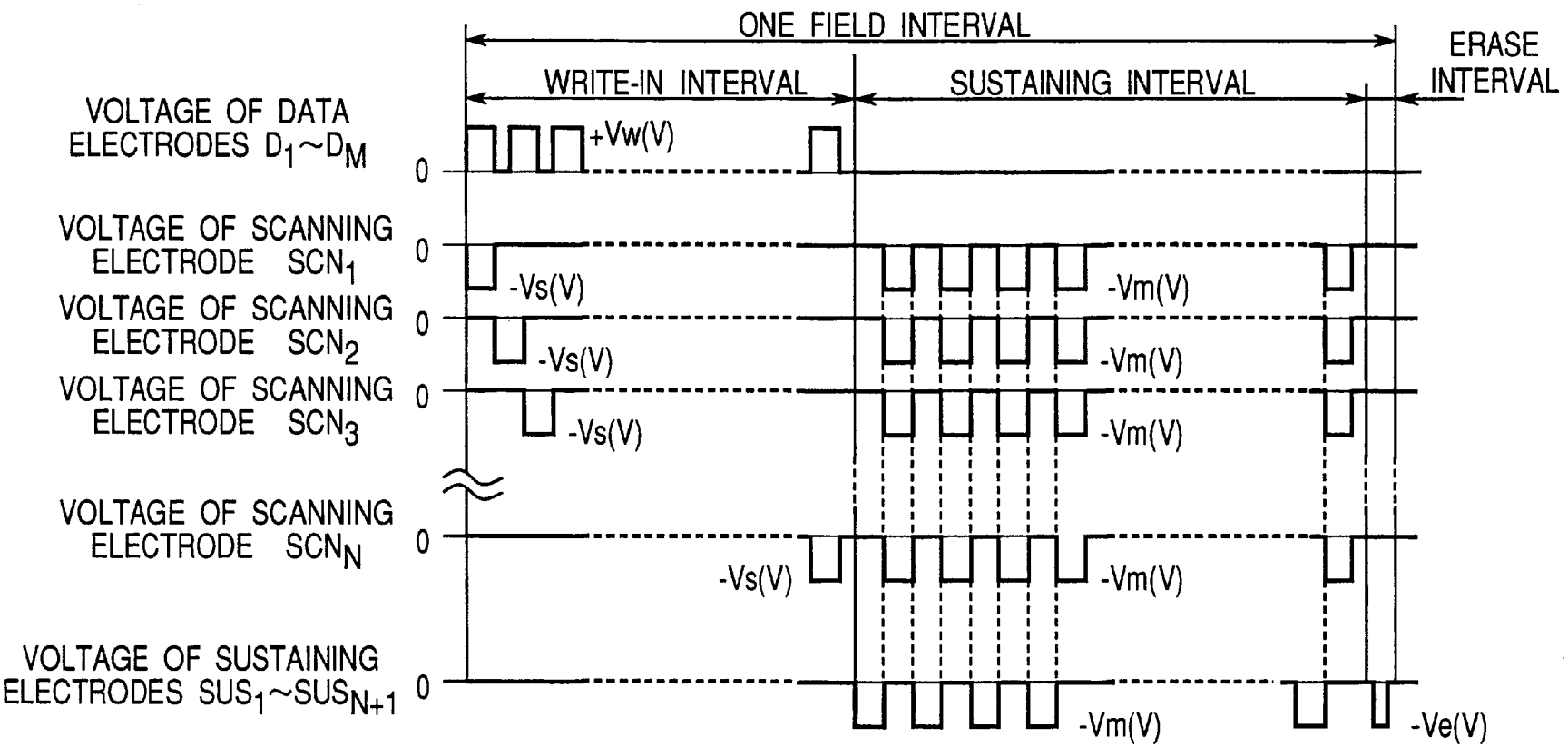
FIG. 7 is a timing chart showing how the PDP of the present invention is electrically driven.
Figure 8:
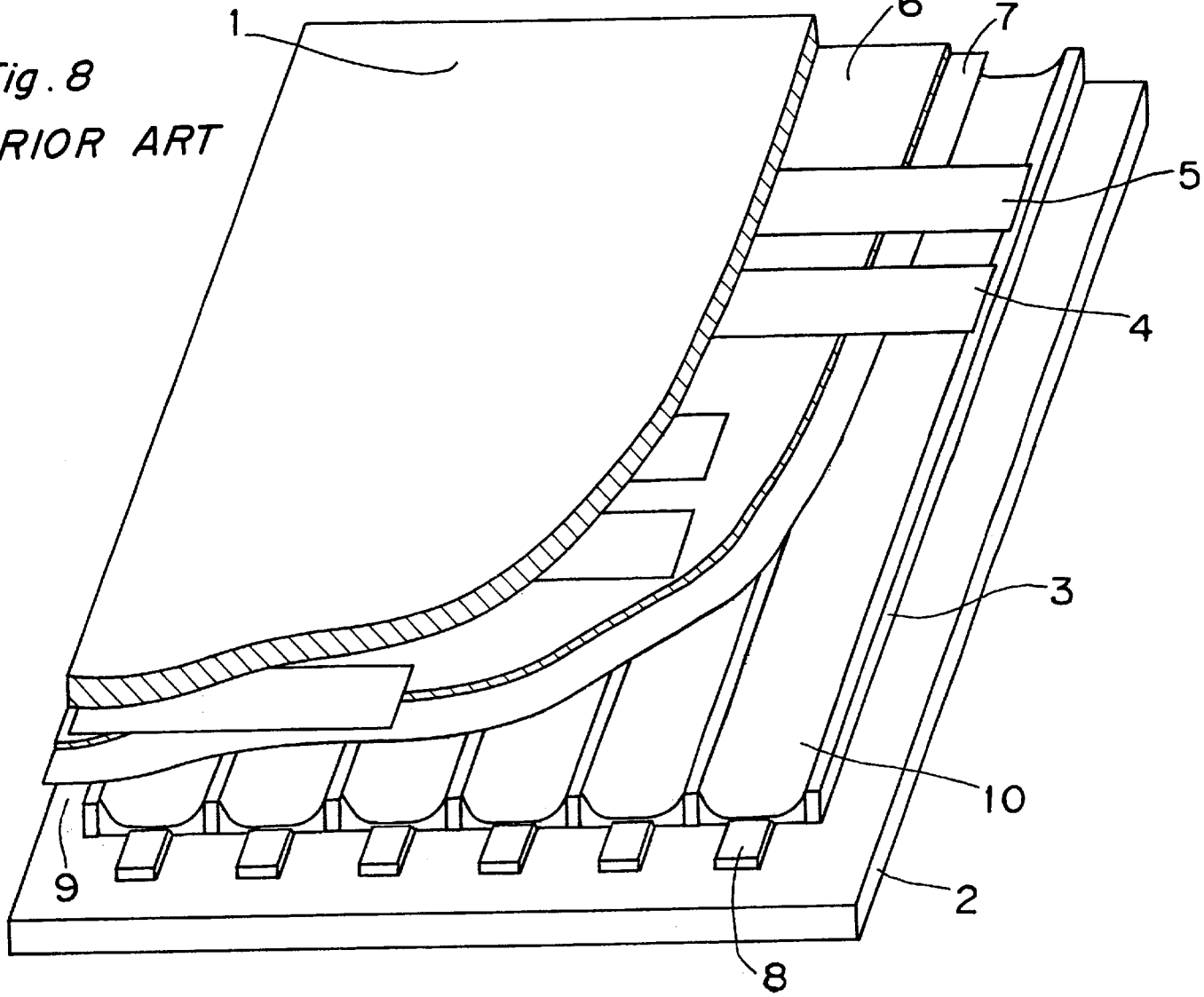
Fig. 8 PRIOR ART
FIG. 8 is a partially cut-out perspective view of the prior art PDP.
Figure 9:
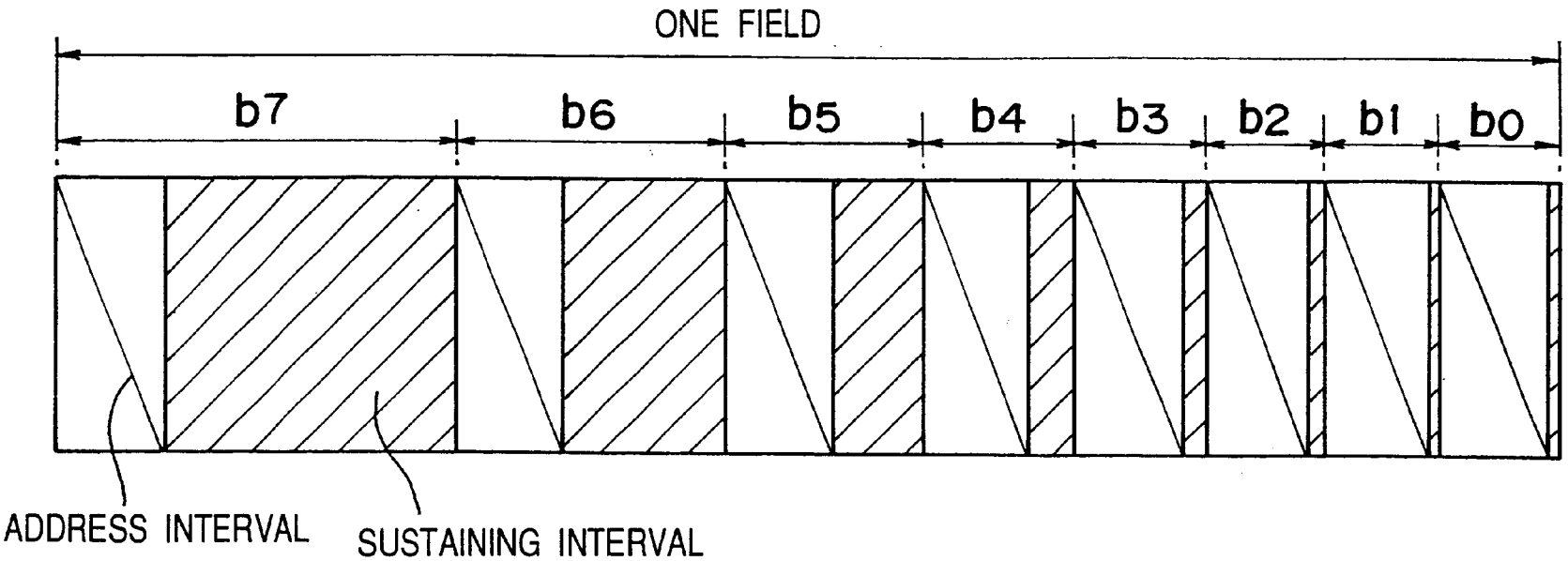
Fig.9 PRIOR ART
FIG. 9 is a timing chart showing a display method in multi-level gradations according to the prior art.

Referring now to FIG. 7, during a write-in interval, an address pulse−Vs(V) is sequentially supplied from the scanning pulse generator to the scanning lines in the order from the top scanning line $SCN_1$. At the timing in which one of the unitary pixels ready to be energized to emit light, a pulse+Vw(V) of a polarity different from the address pulse is applied to the data electrodes $D_1$ to $D_M$ to initiate a discharge and, at the same time, to write a data in the form of a wall charge or a space charge. At the time all of the scanning lines $SCN_1$ to $SCN_N$ have been sequentially scanned in the manner described above, and during a sustaining interval, a sustaining pulse−Vm(V) is alternately applied to the scanning lines $SCN_1$ to $SCN_N$ and also to the sustaining electrodes $SUS_1$ to $SUS_{N+1}$ to thereby allow only some of the pixels, in which the data are written, to sustain emission of light. During the erase interval following the sustaining interval, application of an erasing voltage−Ve(V) to all of the sustaining electrodes $SUS_1$ to $SUS_{N+1}$ results in an erasing discharge with the sustaining discharge consequently brought to a halt.

In the PDP embodying the present invention, the first and second scanning electrodes 12*a* and 12*b* of each set that belong to the same unitary pixel are simultaneously applied with the scanning pulse. Accordingly, the probability that a discharge is formed in each pixel is twice as compared with that in the prior art PDP and, therefore, even in the high-definition PDP in which the width of the address pulse is equal to or smaller than, for example, 2μs, a high-quality image with minimized write-in error can be obtained.

Figure 2:
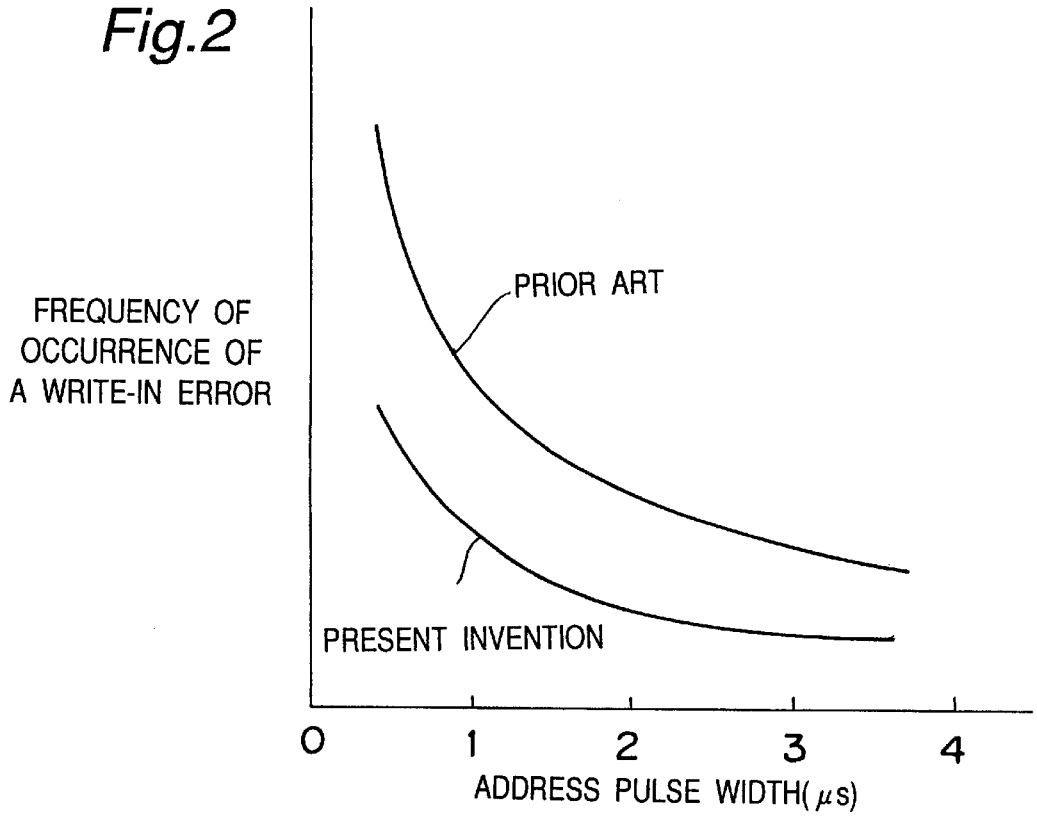
FIG. 2 is a graph showing the relationship between the address pulse width and the frequency of occurrence of a write-in error found in the prior art PDP and the PDP of the present invention.

The possibility of occurrence of the write-in error relative to the varying width of the address pulse in the PDP of the present invention is shown in FIG. 2 together with that in the prior art PDP shown for comparison purpose. According to a series of experiments conducted by the inventors of the present invention, the prior art PDP has proven that reduction in image quality resulting from the write-in error was of no practical problem if the address pulse width was equal to or greater than 3 μs. However, when the address pulse width was about 1 μs, the write-in error has often occurred accompanied by a considerable reduction in image quality.

In contrast thereto, in the PDP employing the electrode structure according to the present invention, the possibility of occurrence of the write-in error is reduced to about ½ of that with the prior art PDP. Accordingly, even if the address pulse width is set to be 1 μs, the PDP of the present invention provides satisfactory image quality that is substantially equal to that obtained with the prior art PDP in which the address pulse width is set to be 3 μs.

Where the 256-gradation display is to be accomplished with the prior PDP with 500 scanning electrodes, the address time required for each field is 12 ms (=3 μ×500×8). On the other hand, where the 256-gradation display is to be accomplished with the PDP of the present invention having 1,000 scanning electrodes, the address time required for each field is 8 ms (=1μs×1,000×8) and, therefore, even though the number of the scanning electrodes is increased twofold as compared with that in the prior art PDP, not only any possible reduction in image quality which would result from the write-in error can be prevented, but also the length of time that can be assigned to the sustaining interval can advantageously be increased.

Figure 3:
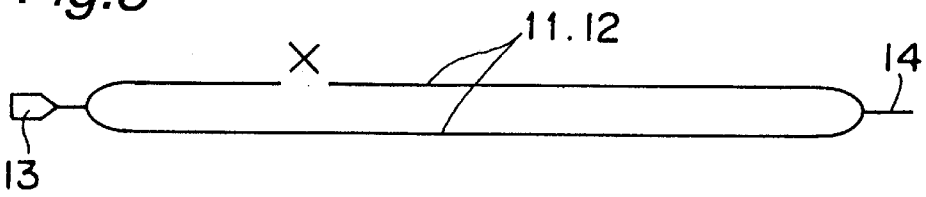
FIG. 3 is a schematic diagram showing the occurrence of a line breakage in one of scanning electrodes of each set, or one of sustaining electrodes of each set, which are employed in the PDP of the present invention.
Figure 4:
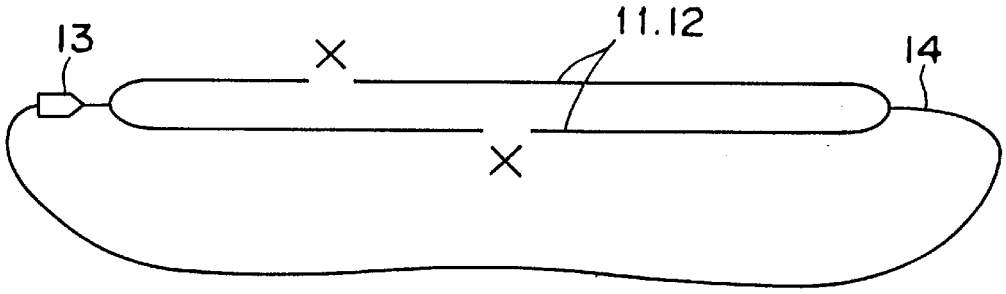
FIG. 4 is a schematic diagram showing the occurrence of a line breakage in both of the scanning electrodes of each set or the sustaining electrodes of each set.

Furthermore, the present invention brings about an additional advantage in that even if a line breakage occurs somewhere in one of the first and second sustaining electrodes 11*a* and 11*b* of each set and/or one of the scanning electrodes 12*a* and 12*b* of each set, this line breakage would not substantially result in a detrimental defect in image display. Specifically, as shown in FIG. 3, even though the line breakage occurs at one of the first and second sustaining or scanning electrodes of any set, the remaining sustaining or scanning electrode survives and, therefore, no substantial reduction in image quality will occur. Considering that some of the electrodes having a partially small width are difficult to find during the inspection process, and even though the electrode partially small in width is broken during the use of the PDP, the PDP will not be considered having a display defect by the same reason. Thus, the present invention is effective to make the excellent PDP available in the market.

Where as shown in FIG. 4 the first and second sustaining or scanning electrode of one set are broken, the occurrence of the display defect can be substantially avoided if the repair terminals 14*a* or 14*b* are connected directly with the pulse generator such as disclosed in the Japanese Laid-open Patent Publication No. 2-284332.

Although the present invention has been described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A plasma display panel which comprises:

first and second substrates disposed in face-to-face relationship with a discharge space intervening therebetween:

a plurality of data electrodes formed on a the second substrate;

a plurality of sets of at least first and second scanning electrodes formed on the first substrate so as to extend perpendicular to the data electrodes;

a plurality of sets of at least first and second sustaining electrodes formed on the first substrate so as to extend perpendicular to the data electrodes and in an alternating fashion with the sets of the scanning electrodes; and a plurality of unitary pixels each defined at an intersection between a data electrode and a group of one set of the scanning electrodes, the first sustaining electrode of one set of sustaining electrodes which is positioned on one side of and adjacent said one set of the scanning electrodes and the second sustaining electrode of the next succeeding set of sustaining electrodes which is positioned on the other side of and adjacent said one set of the scanning electrodes, each sustaining electrode belonging to each set of sustaining electrodes being connected to each other at opposite ends thereof;

each set of the scanning electrodes included within the unitary pixel being adapted to receive a scanning pulse substantially simultaneously.

2. The plasma display panel as claimed in claim 1, wherein each set of the scanning electrodes are connected at their opposite ends with each other.

3. The plasma display panel as claimed in claim 2, further comprising a circuit connecting terminal disposed in the plasma display panel at a location outside a sealing zone, said circuit connecting terminal being electrically connected with one of the connected ends of the scanning or sustaining electrodes of each set.

4. The plasma display panel as claimed in claim 3, further comprising a repair terminal connected with one of the connected ends of the scanning or sustaining electrodes of each set.

5. The plasma display panel as claimed in claim 2, further comprising a repair terminal connected with one of the connected ends of the scanning or sustaining electrodes of each set.

6. A plasma display panel comprising:

first and second substrates disposed in face-to-face relationship with a discharge space intervening between said first and second substrates;

a plurality of data electrodes formed on the second substrate;

a plurality of sets of at least first and second scanning electrodes formed on the first substrate so as to extend perpendicular to the data electrodes;

a plurality of sets of at least first and second sustaining electrodes formed on the first substrate so as to extend perpendicular to the data electrodes and in an alternating fashion with the sets of scanning electrodes; and a plurality of unitary pixels each defined at an intersection between a data electrode and a group of one set of the scanning electrodes, a first scanning electrode of one set of sustaining electrodes which is positioned on one side of and adjacent said one set of the scanning electrodes and a second sustaining electrode of the next succeeding set of sustaining electrodes which is positioned on the other side of and adjacent said one set of the scanning electrodes, each succeeding set of sustaining electrodes being connected to a different corresponding connection terminal;

each set of the scanning electrodes included within the unitary pixel being adapted to receive a scanning pulse substantially simultaneously.

7. The plasma display panel as recited in claim 6, wherein each set of the scanning electrodes are connected at their opposite ends with each other.

8. The plasma display panel as recited in claim 7, wherein one of the two sustaining electrodes of each set encompassed by each unitary pixel is connected with a sustaining electrode adjacent the one sustaining electrode at their opposite ends and the other of the two sustaining electrodes of each set encompassed by the respective unitary pixel is connected with a sustaining electrode adjacent the other sustaining electrode at their opposite ends.

9. The plasma display panel according to claim 8, further comprising a repair terminal connected with one of the connected ends of the scanning or sustaining electrodes of each set.

10. The plasma display panel according to claim 8, further comprising a circuit connecting terminal disposed in the plasma display panel at a location outside a sealing zone, said circuit connecting terminal being electrically connected with one of the connected ends of the scanning or sustaining electrodes of each set.

11. The plasm a display panel according to claim 10, further comprising a repair terminal connected with one of the connected ends of the scanning or sustaining electrodes of each set.

12. The plasma display panel according to claim 7, further comprising a repair terminal connected with one of the connected ends of the scanning or sustaining electrodes of each set.

13. The plasma display panel according to claim 7, further comprising a circuit connecting terminal disposed in the plasma display panel at a location outside a sealing zone, said circuit connecting terminal being electrically connected with one of the connected ends of the scanning or sustaining electrodes of each set.

14. The plasma display panel according to claim 13, further comprising a repair terminal connected with one of the connected ends of the scanning or sustaining electrodes of each set.

* * * * *

UNITED STATES PATENT AND TRADEMARK OFFICE

CERTIFICATE OF CORRECTION

PATENT NO. : 6,304,031 B1
DATED : October 16, 2001
INVENTOR(S) : K. Wani et al.

It is certified that error appears in the above-identified patent and that said Letters Patent is hereby corrected as shown below:

Column 6,
Line 12, after "on" delete "a".

Column 8,
Line 7, "plasm a" should be -- plasma --.

Signed and Sealed this

Twenty-sixth Day of March, 2002

*Attest:*

*Attesting Officer*

JAMES E. ROGAN
*Director of the United States Patent and Trademark Office*